US005092644A

United States Patent [19]

Melerine

[11] Patent Number: 5,092,644

[45] Date of Patent: Mar. 3, 1992

[54] PERSONNEL AND CARGO NET HAVING A LANDING CUSHION

[75] Inventor: Calvin Melerine, Chalmette, La.

[73] Assignee: Apollo Marine Specialties, Inc., New Orleans, La.

[21] Appl. No.: 520,282

[22] Filed: May 7, 1990

[51] Int. Cl.[5] ..... B66C 1/16

[52] U.S. Cl. ..... 294/77; 267/140; 267/153

[58] Field of Search ..... 294/1.1, 68.1-68.22, 294/77, 67.1; 114/219, 365, 376; 182/138, 139; 248/560, 581, 603, 615, 618; 267/136, 139, 140, 153; 441/80, 83, 87, 129

[56] References Cited

U.S. PATENT DOCUMENTS

| | | | |
|---|---|---|---|
| 2,893,665 | 7/1959 | Paulsen | 267/153 X |
| 3,191,896 | 6/1965 | Nathan | 267/153 X |
| 3,288,405 | 11/1966 | Johnson | 267/153 X |
| 3,418,815 | 12/1968 | Kumazawa | 267/140 X |
| 3,539,173 | 11/1970 | Sampson | 267/140 |
| 3,680,851 | 8/1972 | Takada | 267/140 |
| 3,708,988 | 1/1973 | Miura | 267/140 X |
| 3,827,745 | 8/1974 | Pugh | 294/77 |
| 4,883,301 | 11/1989 | Pugh | 294/77 |

*Primary Examiner*—Johnny D. Cherry
*Attorney, Agent, or Firm*—Stephen R. Doody

[57] ABSTRACT

A net for carrying personnel and cargo having a [cushioning means] compressible member which is removably attached to and extending downwardly from the base of the net for absorbing the landing shock of the net.

9 Claims, 3 Drawing Sheets

PERSONNEL AND CARGO NET HAVING A LANDING CUSHION

BACKGROUND OF INVENTION

The present invention relates in general to personnel and cargo nets having a cushion for safely landing such nets as to avoid disturbing their contents.

U.S. Pat. No. 3,827,745 discloses a net which may be used to transfer personnel and cargo from one location to another. Said patent discloses circumferential padding which is lashed to the outside of the base of the net, said padding being intended in part to absorb shock upon landing of the net.

There are, however, disadvantages associated with padding of the type disclosed in U.S. Pat. 3,827,745. Among other things, such circumferentially positioned padding has a tendency, after several landings, to be permanently repositioned, i.e., moved vertically upwards, thereby minimizing its effectiveness as a shock absorbing means. Moreover, because the padding is lashed about the entire circumference of the net, it is very inconvenient and expensive to replace or repair in the event it becomes damaged.

SUMMARY OF THE INVENTION

It is an object of the present invention to provide an improved cushion for personnel and cargo nets which is not prone to being moved out of position and which is easily repaired and replaced.

DESCRIPTION OF THE PREFERRED EMBODIMENT

Figure 1:
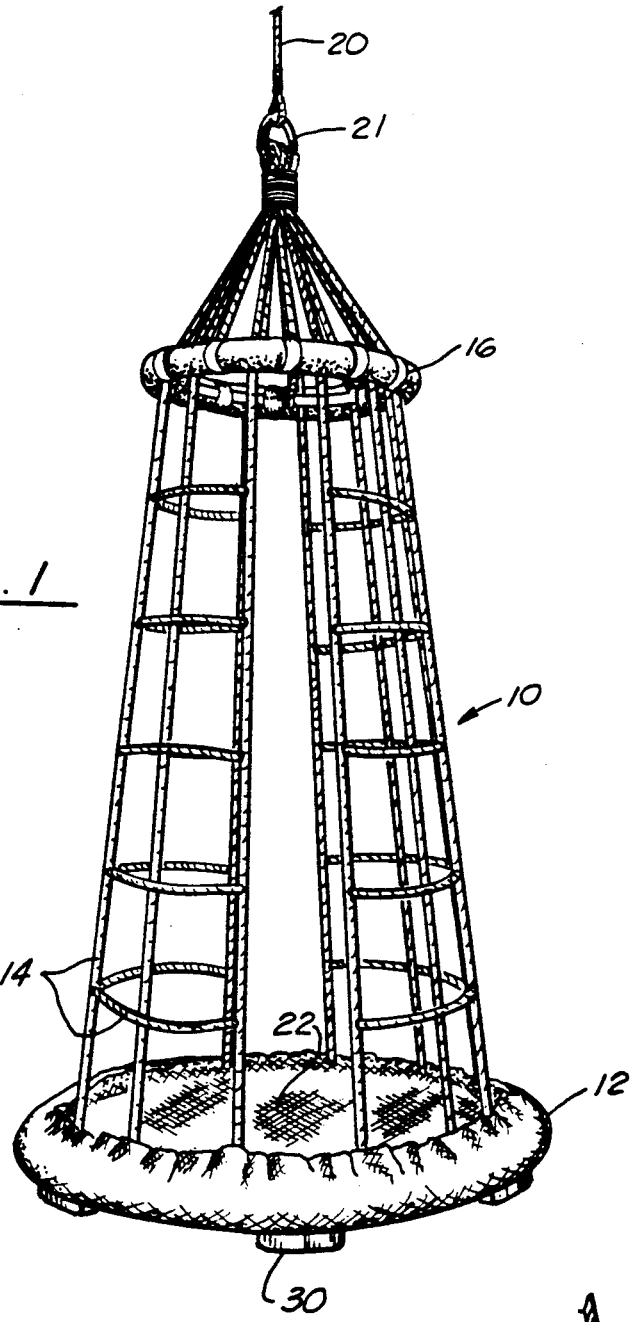
FIG. 1 is a perspective view of a personnel and cargo net equipped with landing cushions in accordance with the instant invention.

The objects and advantages of the present invention are achieved through the provision of a personnel and cargo net, as for example the net 10 which is depicted in FIG. 1. Said net has a base 12 which supports personnel and cargo being transported in the net.

The personnel and cargo being transported by the net are confined to the base by confinement means such as netting 14. Netting 14 is attached to base 12 and extends upwardly. As shown in FIG. 1, the upper ends of netting 14 may be attached to a spreader ring 16, and said spreader ring in turn is attached to a lifting eye 21 Alternatively, netting 14 may extend upwardly from the base 12 of the net for direct attachment to lifting eye 21, without the use of an intervening spreader ring. Lifting cable 20, as from a hoist or crane, lifts and transports the net and its cargo from one location to another.

Figure 2:
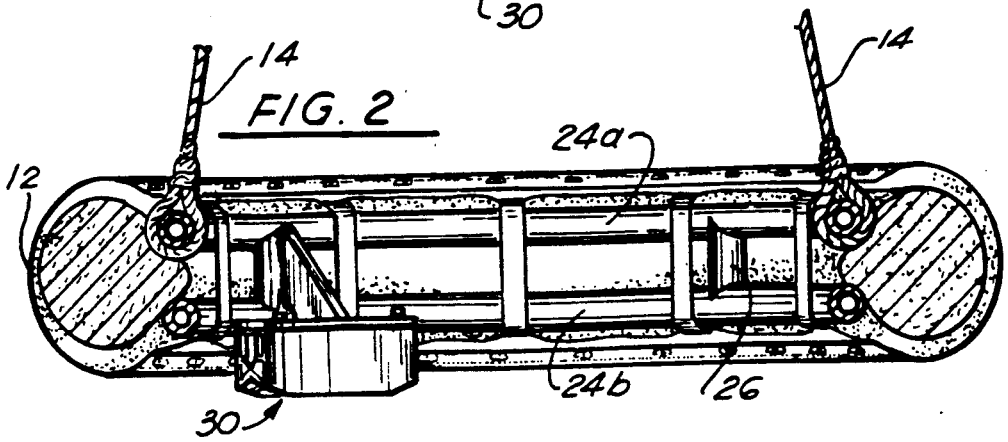
FIG. 2 is a fragmentary cross section of the base of a net illustrating an embodiment of the present invention.
Figure 3:
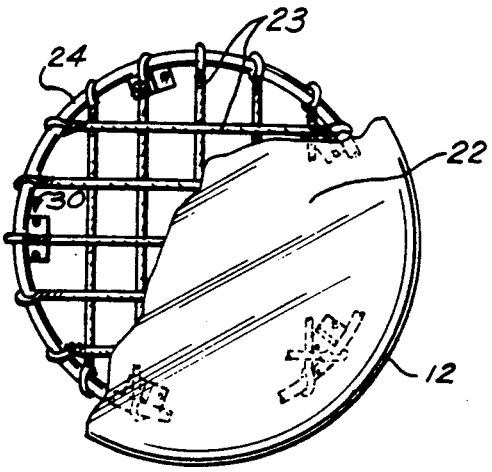
FIG. 3 is a top view of the base of a net, with portions cut away.

The base 12 of the net is provided with floor 22. As best shown in FIG. 3, floor 22 extends over load carrying members, such as support lines 23. Support lines 23 are secured at their respective ends to base support means 24, said support means being located near or at the periphery of floor 22. As shown in FIG. 2, base support means 24 is preferably comprised of parallel, hollow tubes, **24*a* and 24*b*, situated one over the other and spaced apart by vertical spacers 26**.

Figure 5:
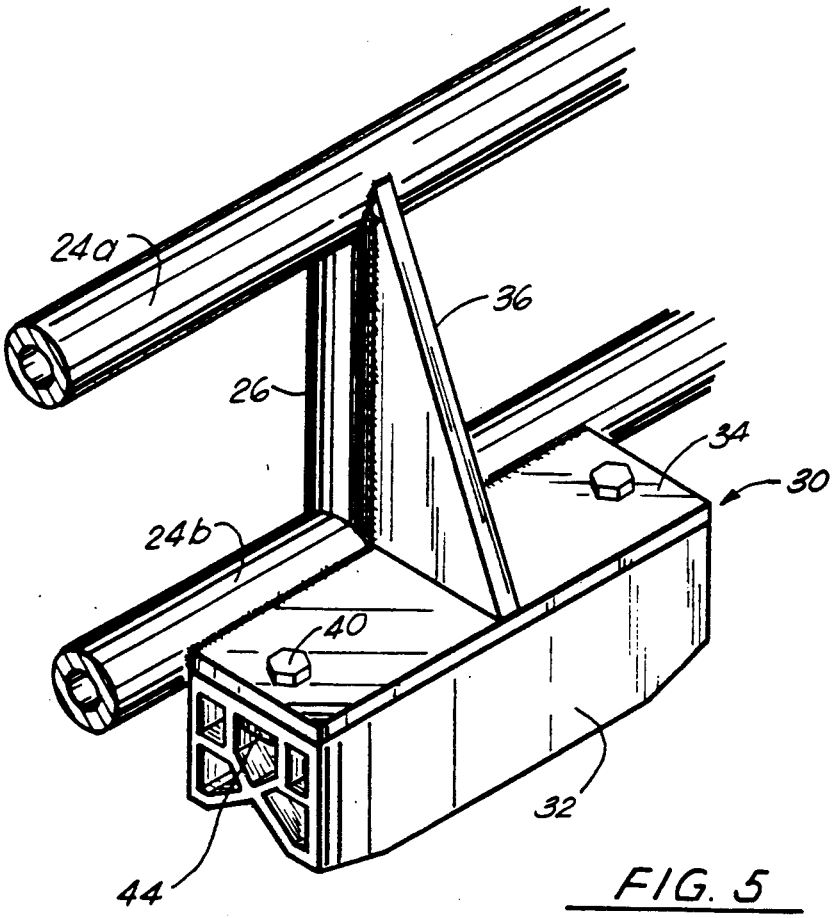
FIG. 5 is a perspective view of the cushion in accordance with the instant invention, illustrated in place on the base of the net, with portions of the base cut away.

Extending downwardly from base 12 and below base support means 24 is cushioning means 30. As best shown in FIG. 5, cushioning means 30 includes compressible member 32, which is attached to mounting plate 34. Mounting plate 34 is securely fixed to base 12, preferably by welding an edge of plate 34 to tube **24*b*. Plate 34 may be reinforced, such as by gusset 36, which is welded to vertical spacer 26**.

Figure 4:
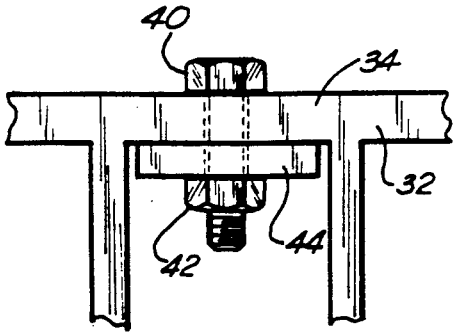
FIG. 4 is a fragmentary side view of a portion of the cushion in accordance with the instant invention.
Figure 6:
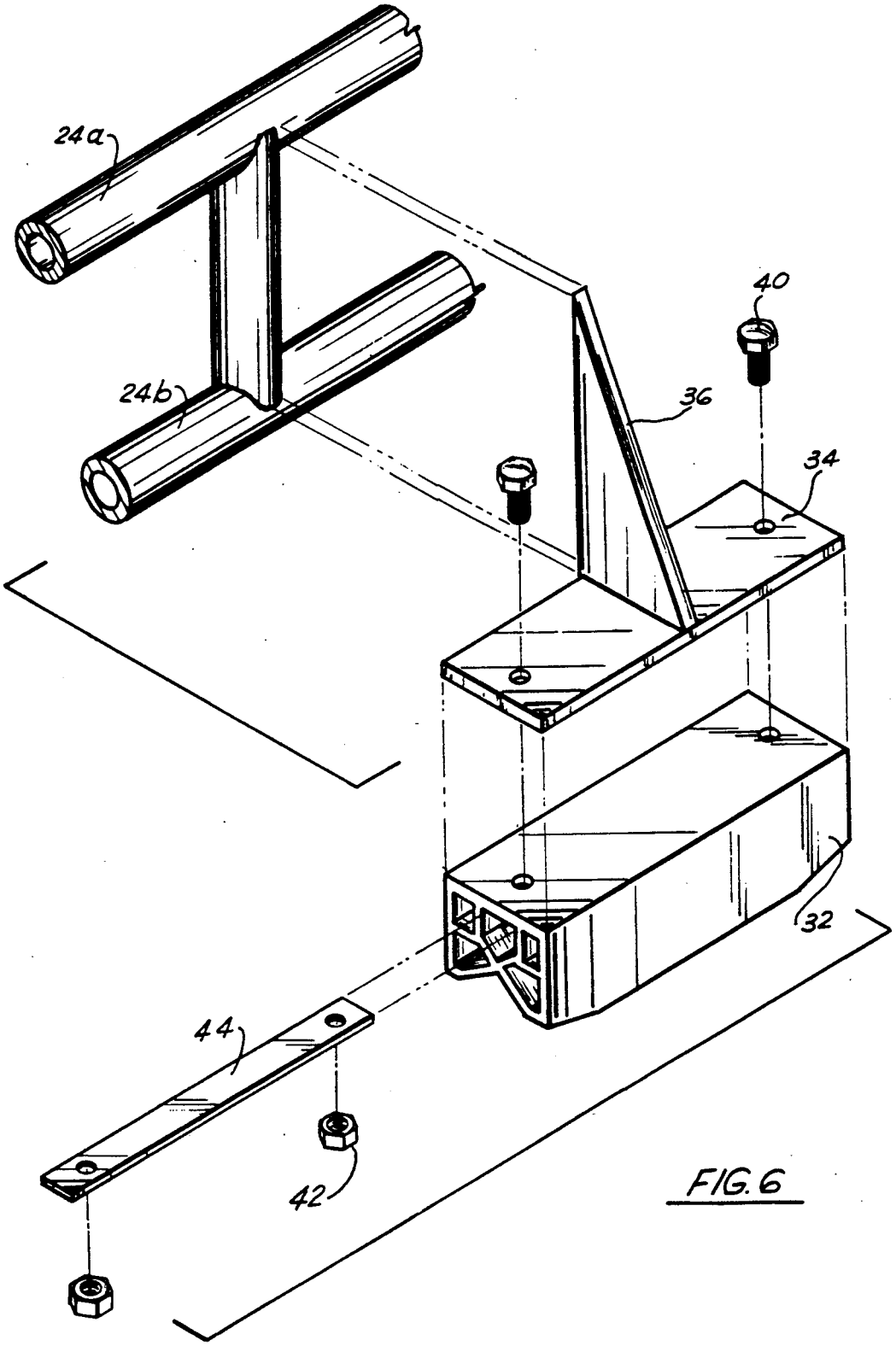
FIG. 6 is an exploded, perspective view of the cushion in accordance with the instant invention, illustrating a method of attachment to the base of the net, with portions of the base cut away.

In the preferred embodiment of the invention, compressible member 32 is removably attached to mounting plate 34 and has a partially hollow or honey-combed interior, as depicted in FIGS. 5 and 6. Compressible member 32 may be attached to plate 34 in any number of ways, such as by gluing or screwing, although the preferred method is by the bolt 40 and nut 42 arrangement appearing in FIGS. 4, 5 and 6.

To prevent tearing of compressible member 32 at the point of its attachment to plate 34, reinforcement means is provided, such as reinforcing strip 44 which is shown best in FIG. 6. Reinforcing strip 44 is preferably located within a hollow of compressible member 32.

In the preferred embodiment of the present invention, a plurality of cushioning means 30 are provided around the perimeter of base 12, within the periphery of base support means 24, as shown in FIG. 3. If the compressible member 32 of a particular cushioning means 30 becomes damaged or worn, it may be easily and economically replaced without the necessity of repairing or replacing all of the other cushioning means. To replace a compressible member 32, as shown in the preferred embodiment in FIG. 6, it is simply unbolted from plate 34 and a fresh compressible member may then be bolted into position.

Upon landing of the net, compressible member 32 absorbs the landing shock by temporarily deforming. However, mounting plate 34 remains stationary, thereby assuring that the compressible member 32 will be in the proper position to absorb shock upon subsequent landings of the net.

While a specific embodiment of the invention has been shown and described in detail to illustrate the application of the principles of the invention, it will be understood that the invention may be embodied otherwise without departing from such principles.

What is claimed is:

1. A net for carrying and landing personnel and cargo, comprising:

a base;

means for confining personnel and cargo to the base; and a plurality of cushioning means for absorbing the landing shock of the net, each of said cushioning means including a mounting plate fixedly attached to the base and a compressible member removably attached to the mounting plate such that a compressible member of a cushioning means may be removed without removing the compressible members of the other cushioning means.

2. The net of claim 1 wherein the compressible member is partially hollow.

3. The net of claim 2 including reinforcing means positioned in a hollow of the compressible member.

4. The net according to claim 2 wherein the base includes parallel upper and lower support means spaced apart by vertical spacers and wherein the mounting plate is securely attached to the lower base support means.

5. The net of claim 4 wherein the cushioning means are located within the periphery of the base support means and extend below said base support means.

6. In a net for carrying and landing personnel and cargo, said net having a base which includes a floor and base support means located near the periphery of said floor, wherein the improvement comprises a plurality of cushioning means for absorbing the landing shock of the net, each of said cushioning means including a mounting plate fixedly attached to the base and a compressible member removably attached to said mounting plate such that the compressible member of a cushioning means can be removed independently from the other cushioning means.

7. The net as recited in claim 6 wherein the cushioning means are located within the periphery of the base support means and extend below said base support means.

8. The net as recited in claim 6 wherein each compressible member has a partially hollow interior and is attached to its respective mounting plate by way of a bolt which extends from the mounting plate into the hollow interior of said compressible member.

9. The net as recited in claim 8 wherein each cushioning means includes reinforcing means located in the hollow interior of the compressible member.

* * * * *